United States Patent [19]

Kistner et al.

[11] 4,095,781

[45] Jun. 20, 1978

[54] CURRENCY DISPENSING APPARATUS

[75] Inventors: Jerome L. Kistner; Thomas R. Aultz, both of Cincinnati; John A. Lampl, Hamilton; William T. Uhlman, Cincinnati, all of Ohio

[73] Assignee: The Mosler Safe Company, Hamilton, Ohio

[21] Appl. No.: 724,112

[22] Filed: Sep. 17, 1976

[51] Int. Cl.[2] ..... B65H 3/14; B65H 5/08

[52] U.S. Cl. ..... 271/12; 221/21; 221/211; 271/30 R; 271/94; 271/98; 271/171; 271/263; 271/DIG. 9

[58] Field of Search ..... 221/21, 198, 211, 231, 221/242, 253; 194/DIG. 26, 4; 271/11, 12, 30 R, 94, 98, 119, 171, 262, 263

[56] References Cited

U.S. PATENT DOCUMENTS

| | | | |
|---|---|---|---|
| 1,331,977 | 2/1920 | Bieri | 271/98 |
| 1,418,145 | 5/1922 | Fischer | 271/98 |
| 2,272,682 | 2/1942 | Srodulski | 221/242 X |
| 2,406,766 | 9/1946 | Harrold | 271/98 |
| 3,145,066 | 8/1964 | O'Neal | 221/242 |
| 3,416,705 | 12/1968 | Hohmann | 271/231 X |
| 3,685,690 | 8/1972 | Karecki et al. | 194/4 R X |
| 3,795,395 | 3/1974 | Ransom et al. | 271/119 X |
| 3,937,453 | 2/1976 | Hickey et al. | 271/263 X |
| 3,954,260 | 5/1976 | Morello et al. | 271/263 X |
| 3,991,888 | 11/1976 | Beckius et al. | 221/242 X |

*Primary Examiner*—Robert B. Reeves
*Assistant Examiner*—Fred A. Silverberg
*Attorney, Agent, or Firm*—Wood, Herron & Evans

[57] ABSTRACT

Currency dispensing apparatus is disclosed in which vertically stacked bills located in a removable container positioned in the dispenser are fed one-by-one from the top of the stack through an opening in the container ceiling by a proximately located overlying rotary suction head. The head advances the bills to the nip of a pair of superimposed bill transport belts overlying the stack from which point they are then transported by the belts back over the top of the stack to a diverter whereat the bills are either diverted to an underlying reject bin located adjacent the stack or to a delivery chute for manual removal by a customer. A multiple, or overlapped, bill sensor is located along the bill transport path between the suction pickup head and the diverter which, in cooperation with suitable control circuitry responsive to the sensor, controls the diverter for diverting multiple, or overlapped, bills into the underlying reject bin while allowing single bills to be transported to the customer delivery chute. A vertically reciprocable stack-supporting platform mounted to the dispenser frame independently of the removable currency container is received within the container, when the latter is located in the dispensing apparatus in underlying relationship to the stack, for advancing the stack upwardly to locate the top of the stack proximate the opening in the container ceiling in operative relationship to the suction head to facilitate pickup and feeding of bills to the nip of the transport belts.

16 Claims, 12 Drawing Figures

CURRENCY DISPENSING APPARATUS

This invention relates to sheet feeding apparatus, and more particularly to apparatus designed to transfer paper currency one-by-one from the top of a stack to a delivery point whereat it can be manually removed by a customer, but which apparatus in the event that a misfeed occurs in which multiple, or overlapped, bills are removed from the stack functions to delivery such misfed bills to a reject bin inaccessible to the customer.

In the design of apparatus for feeding paper currency, or bills, special precautions must be taken to avoid feeding multiple bills when the feeding of single bills on a sequential, one-by-one basis is contemplated. If such precautions are not taken, expensive monetary losses can occur. Automated bank teller equipment, with which the currency dispenser of this invention possesses a high degree of utility, are often designed to dispense variable amounts of cash on a credit basis to a customer upon insertion of a credit card and selection of an amount. If the customer requests $40.00, which requires that four ten-dollar bills be dispensed one-by-one, assuming the dispenser is stocked with ten-dollar bills, should the machine instead dispense five ten-dollar bills because two bills are fed in a single bill-dispensing operation instead of one, a ten-dollar loss results. Should this occur eight or ten times each day, the loss soon becomes staggering.

In addition to requiring that dispensers which handle currency not feed multiple bills when single bill feed is contemplated, it is also essential that the currency dispenser be extremely reliable from the standpoint of operating long periods of time without maintenance, jams, or the like. For example, often automatic bank tellers which dispense cash on credit are located at remote locations, such as suburban shopping centers, where in addition to being available for customer use 24 hours a day, 7 days a week, the equipment is also unattended. Under such circumstances it is important that the currency dispensing equipment require little maintenance, otherwise the cost involved in sending maintenance personnel to outlying locations becomes prohibitive. In addition, and primarily for reasons of public relations and customer satisfaction, the equiment must be available and operating on a continuous 24-hour day, 7 days per week basis without breakdowns so that customers seeking to obtain cash, particularly during nonbusiness hours when conventional banks are closed, will be able to do so and not be disappointed by machine failures.

Accordingly, it has been an objective of this invention to provide a currency dispenser particularly suitable for use in un-attended 24-hour a day automatic bank teller equipment, which minimizes monetary losses due to feeding multiple bills when single bill feed is contemplated and which operates on a continuous basis for extended periods of time without maintenance.

In accordance with one aspect of this invention a currency dispenser is provided for sequentially feeding single bills from the top of a stack of superimposed bills. The dispenser includes a rotary suction head mounted for movement about a horizontal axis overlying the stack such that the suction head moves through a circular path in which the lower extremity thereof is coincident with a bill pickup region proximate the uppermost bill of the underlying stack. Also included, for transporting a bill therebetween, are upper and lower cooperating food belts trained over upper and lower sets of spaced apart rotating cylindrical rolls. The transport belts have a nip at an entrance end to which a bill is fed by the suction head for transport to an exit end remote therefrom. One of the rolls of the lower set over which the lower belt trains is positioned in juxtaposition to the suction overlying the stack. This roll has a diameter less than that of the circular path of the juxtaposed suction head and is rotatable about a second generally horizontal axis offset relative to the axis of the suction head.

The offset axial mounting and diameter differential arrangement of the juxtaposed belt roll and suction head render the circular path of the suction head in the area of the bill pickup region noncoincident with the surface of the adjacent cylindrical roll, while rendering the circular suction head path coincident with the surface of the cylindrical roll in the region of the nip of the belts. As such, minimal interference occurs between the uppermost bill of the stack and the lower feed belt during vacuum pickup by the suction head when the latter is in its lowermost position, while maximizing transfer of a bill from the suction head to the upper and lower belts at the nip for subsequent transport to the customer.

In a preferred form of the invention the feed belts are disposed to overly the currency stack with the exit end of the belt transport proximate the end of the stack remote from the bill pickup region. At the exit end of the belts a bill diverting element is provided which is designed to move, on an alternative basis, between first and second positions to divert a bill transported between the belts to either a reject point below the diverter adjacent the stack or a delivery point whereat a customer can manually remove it. Also included is a multiple, or overlapped, bill sensor disposed along the belt transport path upstream of the diverter for detecting multiple, overlapped bills. The sensor, in conjunction with suitable control circuitry responsive thereto, functions to cause the bill diverter to either divert multiple bills, which constitute a mis-feed, to the reject point underlying the diverter adjacent the stack, while passing single bills to the delivery point for removal by the customer.

The foregoing feature of the invention, in which bills are fed from the top of the stack back over the stack and either to an underlying reject bin adjacent the stack or to a delivery chute for removal by the customer, provides an extremely compact currency dispenser having a relatively short transport path for the bills, and yet one which has the capability of rejecting and storing mis-fed overlapped/multiple bills.

In accordance with a further aspect of the invention a bill dispenser is constructed which is designed to maintain the height of the stack at the level necessary for reliable top feed by the suction head, while eliminating the need for a stack height sensor customarily located proximate the top of the stack. This is accomplished by providing a stack-elevating platform underlying the stack, and an intermittently operable platform drive means for incrementally moving the platform upwardly to incrementally raise the stack a predetermined distance, for example, one eighth inch. In addition, control means are provided which are repeatedly responsive to the repeated failure to feed a bill from the top of a stack upon repeated rotation of the suction head for repeatedly actuating the platform incrementing drive to repeatedly raise the platform and stack predetermined increments.

The foregoing arrangement results in elevating the stack on an "as needed" basis, with "need" being determined by the failure of the dispenser to feed a bill from the top of the stack when the suction had has cycled through one revolution and a bill should otherwise be fed. As noted, an advantage of this scheme is that an independent stack height sensor, of either the "contacting" type, such as a limit stop or feeler which engages the uppermost bill, or of the non-contacting type, such as a photosensing arrangement, is unnecessary. Contacting-type height sensors, such as feelers, apply a frictional drag force to the top of the bill, inhibiting feeding, and are therefore undesirable. While non-contacting sensors do not apply frictional drag to the uppermost bill of the stack, such can also produce bill feed failure. For example, should the portion of the uppermost bill adjacent the non-contacting photosensor be wrinkled and at an elevation above the portion of the bill which is to engage the suction head, the photosensor can be triggered prematurely, i.e., before that portion of the top of the stack underlying the suction head is at the desired operating level, resulting in non-feed type failure.

In accordance with a still further aspect of the invention control means are provided for automatically recycling the feeder in the event a feed cycle results in feeding multiple bills which, as noted previously, are not delivered to the customer, but rather diverted into the underlying rejection bin when sensed by the multiple bill sensor. By virtue of this feature, after a mis-feed occurs, such as multiple bills, and the multiple bills have been returned to a rejection bin thereby avoiding monetary loss, the apparatus immediately initiates a new feed cycle in an effort to deliver a single bill and thereby supply the customer's request for currency. When a single bill is transported to the delivery point for manual removal by the customer, cycling of the dispenser is interrupted until such time as the customer manually removes the properly fed single bill. Once the customer has removed the properly fed bill, cycling of the feeder resumes to feed the next bill.

In accordance with a further, and also important, aspect of the invention, a removable container, which is separate and structurally independent of the dispenser frame which mounts the suction head, belt transport and diverter, is provided for storing currency both within the dispenser as well as outside it. The container is configured to contain a stack of currency and has interconnected walls, floor and ceiling, with the ceiling having an opening adopted to underlie the suction head when the container is positioned in the dispenser. Cooperating locating means associated with the container and the dispenser frame which, among other things, mounts the suction head serve to positively locate the container relative to the suction head when the container is installed in the dispenser. The container has a slot in one wall thereof configured to permit insertion and reciprocation of the stack-elevating platform within the container interior when the removable container is located in the machine. By virtue of this removable container structure, convenient containment means are provided for storing and transporting currency outside the dispenser, but yet when the dispenser is to be loaded with currency it is not necessary to remove the currency from the container prior to transfer to the dispenser. Rather, the currency stack, as well as the container in which it is stored and transported outside the dispenser, can be inserted directly into the dispenser.

These and other advantages and objectives of the invention will become more readily apparent from a description thereof taken in conjunction with the drawings in which.

Figure 1:
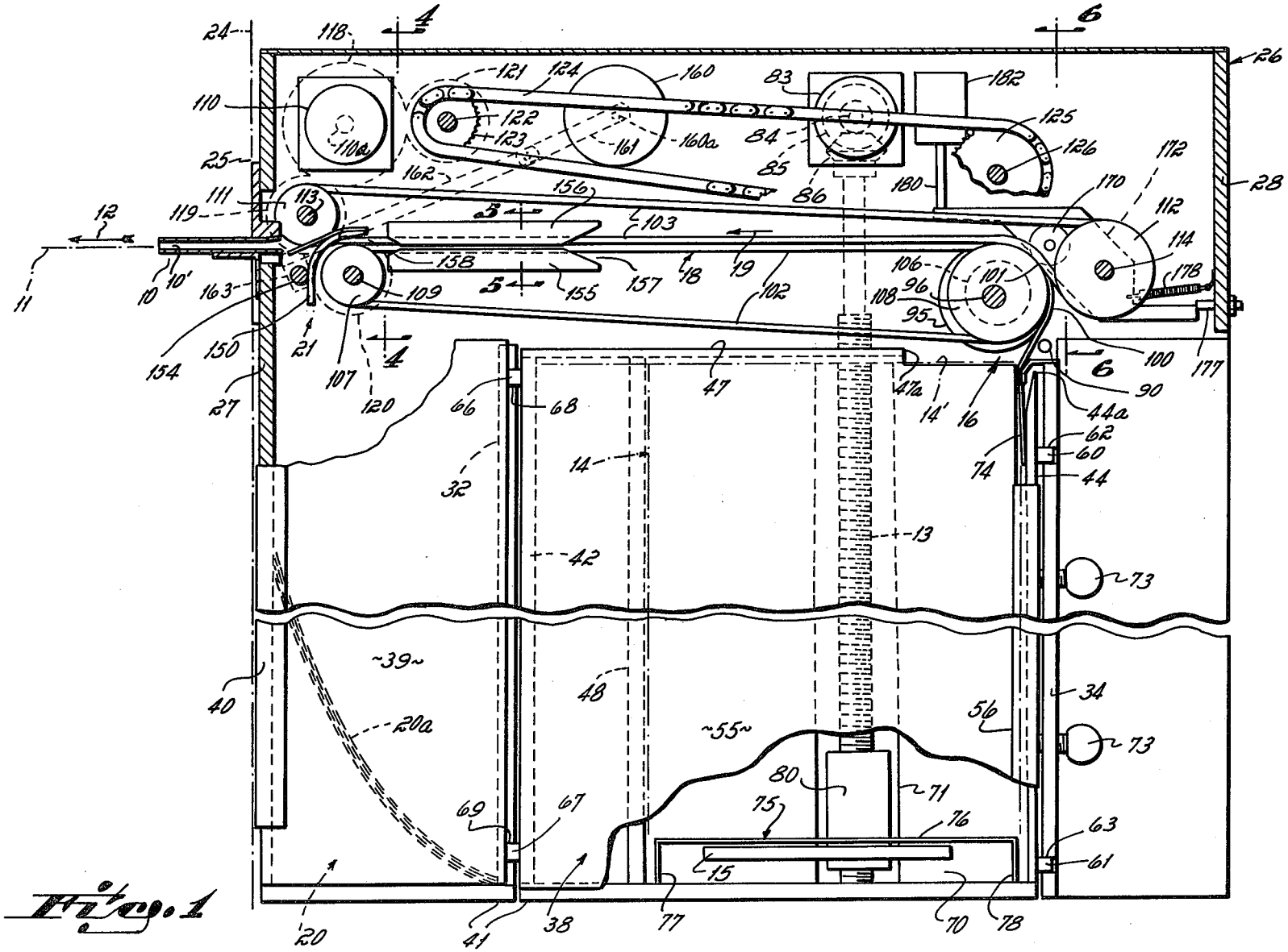
FIG. 1 is a side elevational view, partially in cross-section, of the currency dispensing apparatus of this invention.
Figure 4:
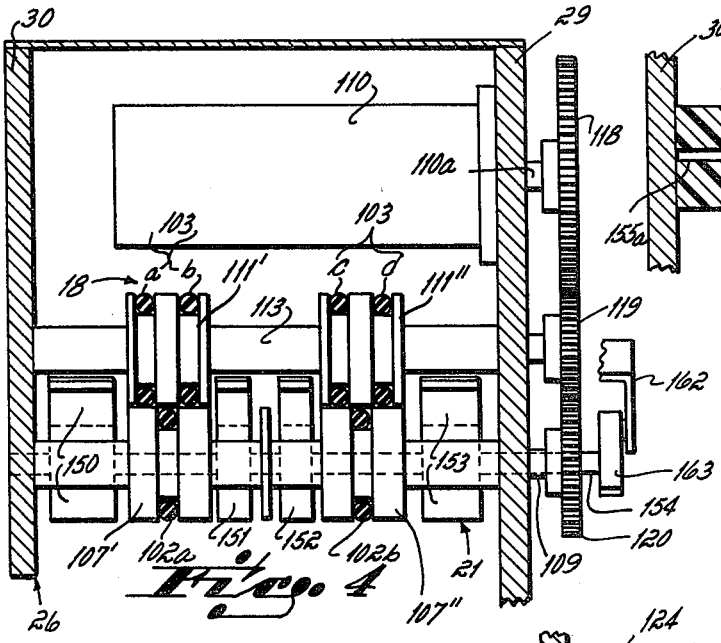
Figure 5:
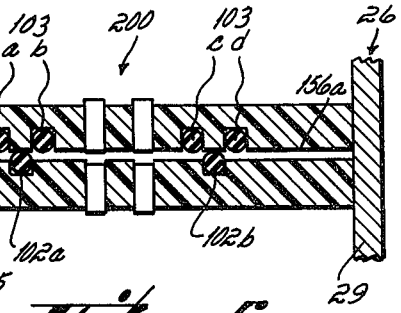
Figure 5A:
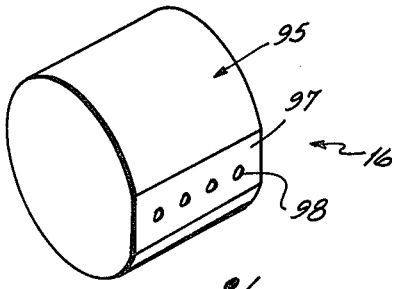
Figure 6:
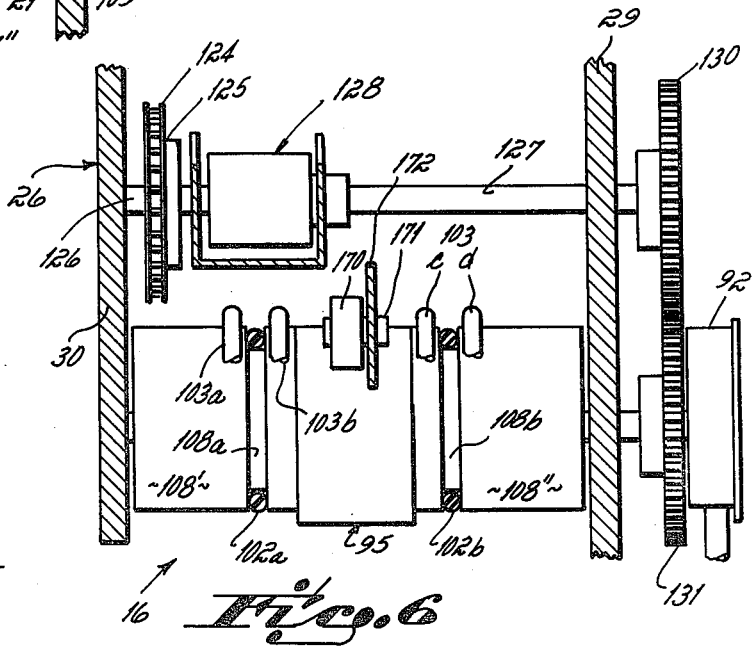
Figure 8:
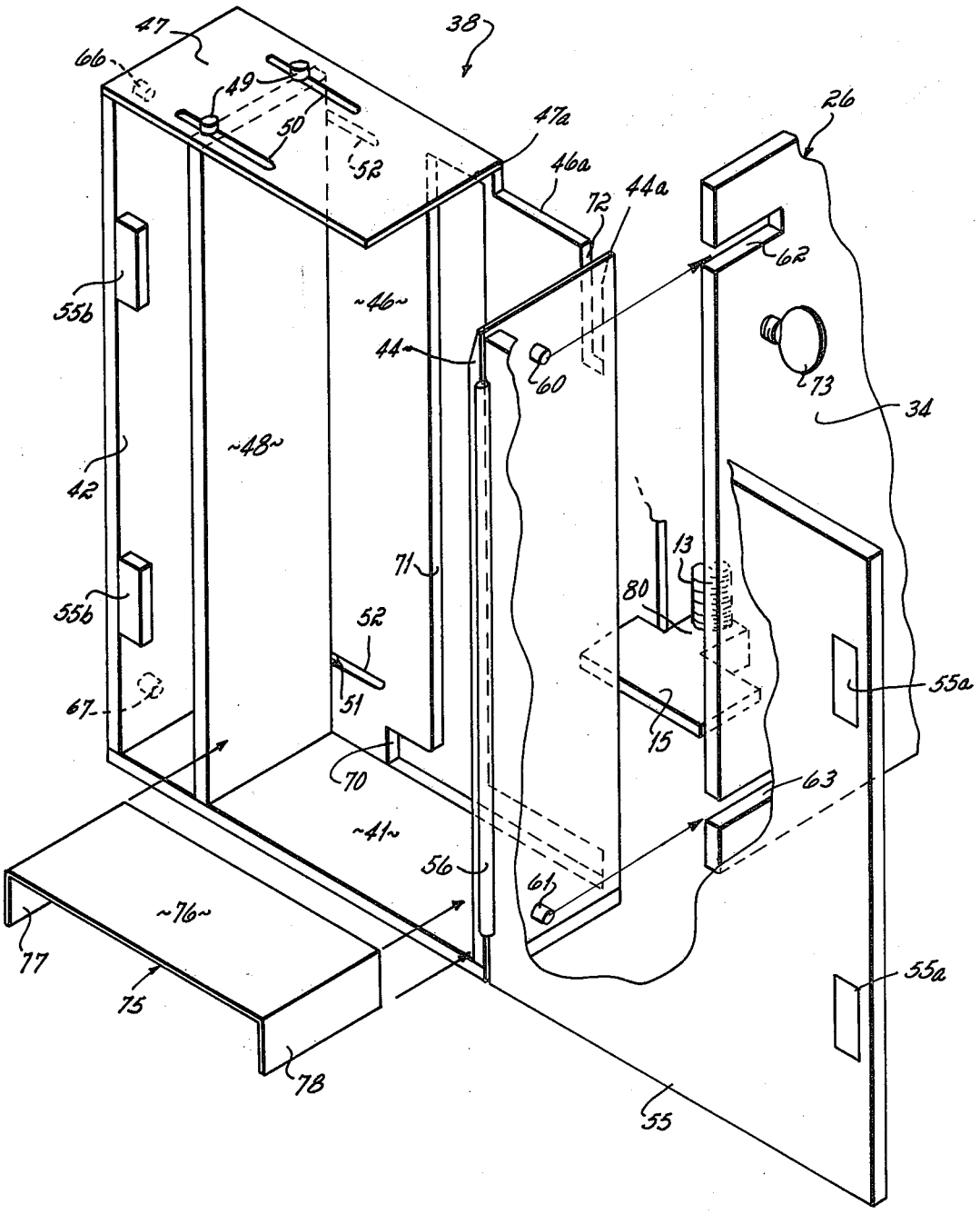
Figure 10:
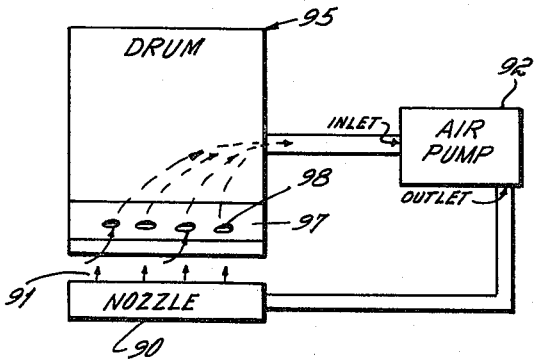
Figure 9:
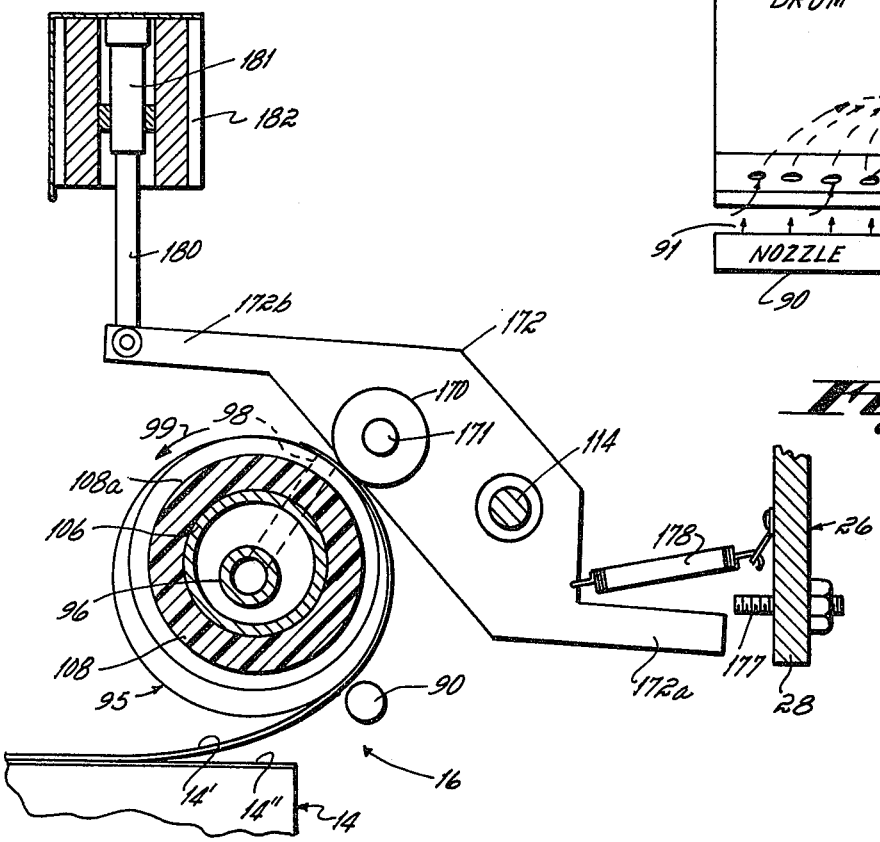
Figure 11:
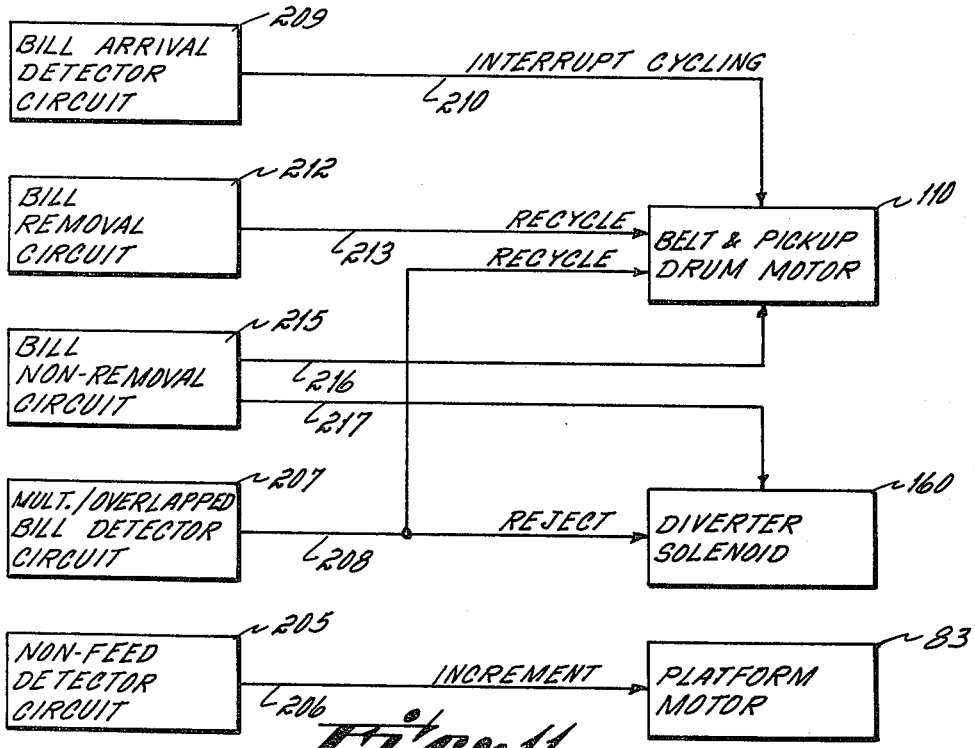

FIG. 3*a* is a perspective view of the vacuum drum;

FIG. 4 is a cross-sectional view along line 4—4 of FIG. 1;

FIG. 5 is a cross-sectional view along line 5—5 of FIG. 1;

FIG. 6 is a cross-sectional view along line 6—6 of FIG. 1;

FIG. 7 is an enlarged cross-sectional view of the diverter assembly;

FIG. 8 is a perspective view of the cash container utilized in the cash dispenser of FIG. 1;

FIG. 9 is an enlarged cross-sectional view of the suction drum and belt-supporting roll adjacent thereto;

FIG. 10 is a diagrammatic perspective view of the suction drum and air nozzle connected to the input and output of a single pump; and FIG. 11 is a schematic diagram in block format of a control circuit useful in controlling various elements of the currency dispenser of this invention.

The currency dispenser, as viewed in side elevation in FIG. 1 includes a horizontally disposed hollow flat discharge chute 10 for dispensing single bills 11 on a sequential basis. The bills are dispensed through an opening 10' in the chute 10 in the direction of arrow 12 whereat they are available for manual removal by a customer. A supply of currency 14 designed to hold approximately 2,000 bills in super-imposed horizontally disposed stacked relation is provided in the dispenser. A vacuum and air assisted currency feeder 16 located above the currency supply stack 14 removes bills from the top of the stack on a one-by-one basis for transport by an overlying belt assembly 18 over a path which successively moves the bill in the direction of arrow 19 back over the top of the supply stack 14 and over a rejected bill bin 20 where a diverter assembly 21 either directs the bill downwardly into the rejected bill bin or horizontally into the chute 10 for delivery to the customer via chute opening 10'.

In the course of travel of a bill from the top of the supply stack 14 to the diverter assembly 21 the bill passes through a thickness tester and a length tester, to be described, to detect partially and/or completely overlapped bills. If partially or completely overlapped bills are detected the diverter assembly 21 diverts the bills into the rejected bill bin 20. If no overlap exists a single bill is being fed and the diverter moves to its non-diverting position to allow the bill to pass out to the user through the chute 10.

A stack elevating assembly, including a platform 15 underlying the bottom of the stack 14 which moves upwardly with a nut 80 threadably engaged by a lead screw 13 is provided to raise the stack such that the uppermost bill 14' is proximate the vacuum and air assisted currency feed assembly 16. This insures that for each operation of the feeder assembly 16, the uppermost bill 14' of the stack 14 is fed from the top of the stack to the belt assembly 18 for transport.

The currency dispenser of this invention is designed to be placed within a housing or enclosure of an automated teller unit which in addition to left and right sidewalls, a rear wall, a floor and a ceiling (none of which are shown), also includes a front wall or facade 24 having an opening 25 designed to receive the chute 10. The automated teller housing is provided with a suitable access door to permit replenishment of the supply stack 14 in a manner to be described.

The currency dispenser, in a preferred form, includes a frame 26 having a front vertically disposed wall 27 which extends for the full height of the dispenser, and a rear vertical wall 28 disposed parallel to the wall 27 which extends downwardly from the top of the dispenser a distance approximately one third the height of the dispenser. The frame 26 also includes a side wall 29 of generally rectangular configuration which extends throughout the entire vertical extent of dispenser between opposed vertical edges **27*a* and 28*a* of the front and rear walls 27 and 28, respectively. A side wall 30, also rectangular in condiguration, extends between opposite vertical side edges 27*b* and 28*b* of the front and rear walls 27 and 28 for a vertical distance coextensive with the height of the ear wall 28. Disposed forwardly and rearwardly of the currency supply stack 14 are a pair of vertically disposed spaced-apart parallel walls 32 and 34 which extend perpendicularly from the inner surface of the side wall 29 to which the walls 32 and 34** are secured along vertical edges thereof.

Walls 32 and 34, along with a portion of the side wall 29 disposed therebetween, constitutes a compartment for storing a removable currency stack container 38 to be described. The front wall 27 nd intermediate wall 32, in conjunction with the portion of the side wall 29 disposed therebetween, function as the rejected bill bin 20 which underlies the diverter assembly 21. A door 39 hinged along its vertical edge 40 to the vertical edge **27*b* of the front wall 27 facilitates selective access to the rejected bill bin 20 for removal of rejected bills 20*a*** which have accumulated therein.

Referring to FIG. 8, the removable currency stack container 38, which fits in the compartment defined by intermediate walls 32 and 34 and the section of side wall 29 which spans therebetween, includes spaced apart parallel vertically disposed front and rear walls 42 and 44 and an interconnecting side wall 46. The container 38 also includes a top wall or ceiling 47 which extends from the upper edge of the front wall 42 toward the upper edge of the rear wall 44 a distance less than the spacing between the front and rear walls 42 and 44, leaving an opening in the ceiling. The opening extends between the rear edge **47*a* of the ceiling and the upper edge 44*a* of the rear wall, and underlies the vacuum and air assisted currency feeder assembly 16 for reasons to become apparent hereafter. Disposed between the front and rear container walls 42 and 44 is a movable divider wall 48 which is vertically disposed parallel to the front and rear walls. Screw fasteners 49, 49 which slide in slots 50, 50 in the container ceiling 47 engage the upper horizontal portion of the divider panel 48 to facilitate secure placement of the divider panel 48 at selected variable distances from the rear wall 44 to accommodate horizontally stacked bills of varying lengths. Variable width bills can be accommodated by varying width of elements 42, 44 and 48. Fasteners 51, 51 which slide in horizontal slots 52 formed in the container side wall 46 engage the vertical edge of the divider panel 48 to assist in securing the divider panel 48 in the desired vertical position spaced from the rear wall 44 a distance dictated by the length of the currency being used. A floor 41 extends across the bottom of the container 38 between front and rear container walls 42 and 44. A rectangular door 55 hinged along its vertical edge at 56 is secured to the righthand vertical edge of the rear wall 44 to facilitate selective access to the currency-containing compartment of container 38 defined by slider panel 48, rear wall 44, side wall 46, ceiling 47 and floor 41**.

Again referring to FIG. 8, the rear wall 44 of the container 38 is provided with rearwardly extending upper and lower locating pins 60 and 61 which seat in horizontal slots 62 and 63 in the frame wall 34 to properly locate the container 38 with respect to the frame when the container is positioned in the cash dispenser frame 26 (as shown in FIG. 1). Similarly, the container front wall 42 is provided with forwardly projecting upper and lower pins 66 and 67 which seat in horizontal slot 68 and 69 formed in the intermediate frame wall 32 to assist in properly locating the container when it is positioned in the cash dispenser frame (FIG. 1). A pair of thumb screws 73 threaded in holes in the frame wall 34 engage the rear surface of the rear wall 44 of the container 38 to facilitate locking the container within the dispenser after it has been positioned between walls 32 and 34 with its locating pins 60, 61, 66 and 67 suitably seated in locating slots 62, 63, 68 and 69.

As shown in FIG. 8, the left side wall 46 of container 38 is provided with a horizontal slot 70 adjacent the floor which extends between the divider panel 48 and the rear wall 44. Connecting with the slot 70 is a vertical slot 71 which extends upwardly to almost the ceiling 47. The horizontal slot 70 enables the stack-elevating platform 15 to be received within the stack-containing chamber formed by panels 48 and 44 in underlying relation to the bottom of the stack 14 when the container 38 is inserted into the dispenser frame as shown in FIG. 1. The vertical slot 71 in the container 38 enables screw-driven nut 80 which mounts the platform 15 to move upwardly to maintain the uppermost bills of the stack proximate the opening in the container ceiling between the edges **47*a* and 44*a*** as the stack is depleted in the course of dispensing bills.

A vertical slot 72 formed in the container side wall 46 proximate the rear wall 44 extends downwardly from the upper edge **46*a* of the side wall. Slot 72 enables the lower vertical end of a currency guide plate 74 secured to the frame rear wall 38 to be received within the stack-containing compartment of the container 38 when the container is inserted into the dispenser frame as shown in FIG. 1**.

A platform extension 75 having a horizontal rectangular upper surface 76 and depending legs 77 and 78 can be fitted in the stack-containing compartment of the container 38 between the upper surface of the movable platform 15 and the lower surface of the bottommost bill in the stack 14. By varying the length of the platform extender measured between depending legs 77 and 78 the fixed length platform 15 can effectively be extended to underlie substantially the entirety of a currency stack 14 notwithstanding variations in length of bills in the stack which are possible when the divider panel 48 is shifted toward and away from the rear container wall 44 to accommodate stacks of bills of different length.

If desired the hinged door 55 can be releasably secured in its closed position by magnetic closure elements **55*a*, 55*a* secured to the door 55 and cooperating magnetic elements 55***b*, 55*b* secured to the compartment wall 42 at points selected to be opposite the elements 55*a*, 55*a* when the door 55 is closed.

The dispenser platform 15 is secured to the nut 80 threaded on the vertically disposed lead screw 13 along the platform edge proximate the inner surface of frame side wall 29. As the vertically disposed lead screw 13, which is journaled for rotation at its upper and lower ends in bearings secured to the outside surface of the left frame wall 29, rotates in opposite directions the platform 15 secured to nut 80 moves up and down depending on the direction and amount of screw rotation. To bidirectionally rotate the lead screw 13 a motor 83, which is secured to the inner surface of the left wall 20 near the upper edge thereof, is provided. The motor 83 is positioned between the left and right frame walls 29 and 30 with its output shaft 84 passing through a suitable oversized opening in the left frame wall 29. Bevel gears 85 and 86 secured to the motor shaft 84 and lead screw 13, respectively, transmit power between the perpendicularly oriented motor shaft 84 and lead screw 13. The nut 80 has secured to it an angulated tab 82, which cooperates with upper and lower phototransducer assemblies 87 and 88 mounted to the outer surface of the side wall 29, for generating a de-energizing signal for lead screw motor 83 when the platform 15 has reached its upper and lower limits of travel. Energization of the motor 83 to elevate the stack of currency 14 can be provided in any suitable manner. Preferably, the motor 83 is energized periodically with electrical pulses to incrementally elevate the platform 15 and the stack of currency 14 supported thereon.

Specifically, in a preferred form of the invention the motor 83 is energized with an electrical pulse of predetermined duration calculated to elevate the platform 15 a predetermined distance, e.g., one-eighth inch, after a predetermined number of unsuccessful attempts by the vacuum and air assisted currency feeder assembly 16 to feed a bill. As long as the feeder assembly 16 feeds a bill for each cycle of operation the height of the stack is assumed to be the proper elevation. However, if the feeder assembly 16 is unable, after a specified number of unsuccessful attempts, e.g., three attempts, to feed a bill from the top of the stack, suitable circuitry (not shown) generates a predetermined duration electrical pulse for energizing the motor 83 which in turn elevates the stack a predetermined amount, such as one-eighth inch. In this way the stack is elevated as needed, without providing a sensor for the top of the stack which detects the level of the uppermost bill 14' of the stack 14.

The utility of eliminating a sensor for the uppermost bill 14' of the stack 14 can be appreciated by considering the alternatives available and the problems they present. For example, if a mechanical feeler is provided overlying the top of the stack which, as the stack is elevated, engages the uppermost bill 14' to trigger a circuit indicating that the uppermost bill of the stack is at the correct height and the platform-elevating motor 83 should be de-energized, the stack-sensing feeler will exert a frictional drag force on the uppermost bill 14' of the stack, tending to inhibit feeding of bills. This is obviously undesirable.

Another possible alternative for detecting the level of the uppermost fill 14' of the stack to control platform-elevating motor 83 is to provide a non-contacting sensor, such as a phototransducer arrangement which senses the position of the uppermost bill 14' without physical contact therewith. While such an arrangement would not apply a frictional, feed-inhibiting force to the uppermost bill 14' of the stack 14, it can produce unreliable stack positioning results. For example, if the uppermost bill 14' of the stack 14 is wrinkled, the bill may extend above the top of the stack a distance greater than the thickness of the bill itself. If the location of the wrinkled portion of the uppermost bill is in the sensible region of the phototransducer which senses the level of the uppermost bill, the phototransducer will be tripped prematurely as the motor 83 elevates the platform 15. As a result, the portion of the uppermost bill of the stack underlies the feeder assembly 16, and which may not be wrinkled, will be spaced below the level optimally desired for reliable feeding of the uppermost bill. As a consequence, the uppermost bill may fail to be fed by the feeder assembly 16.

Figures 1, 2:
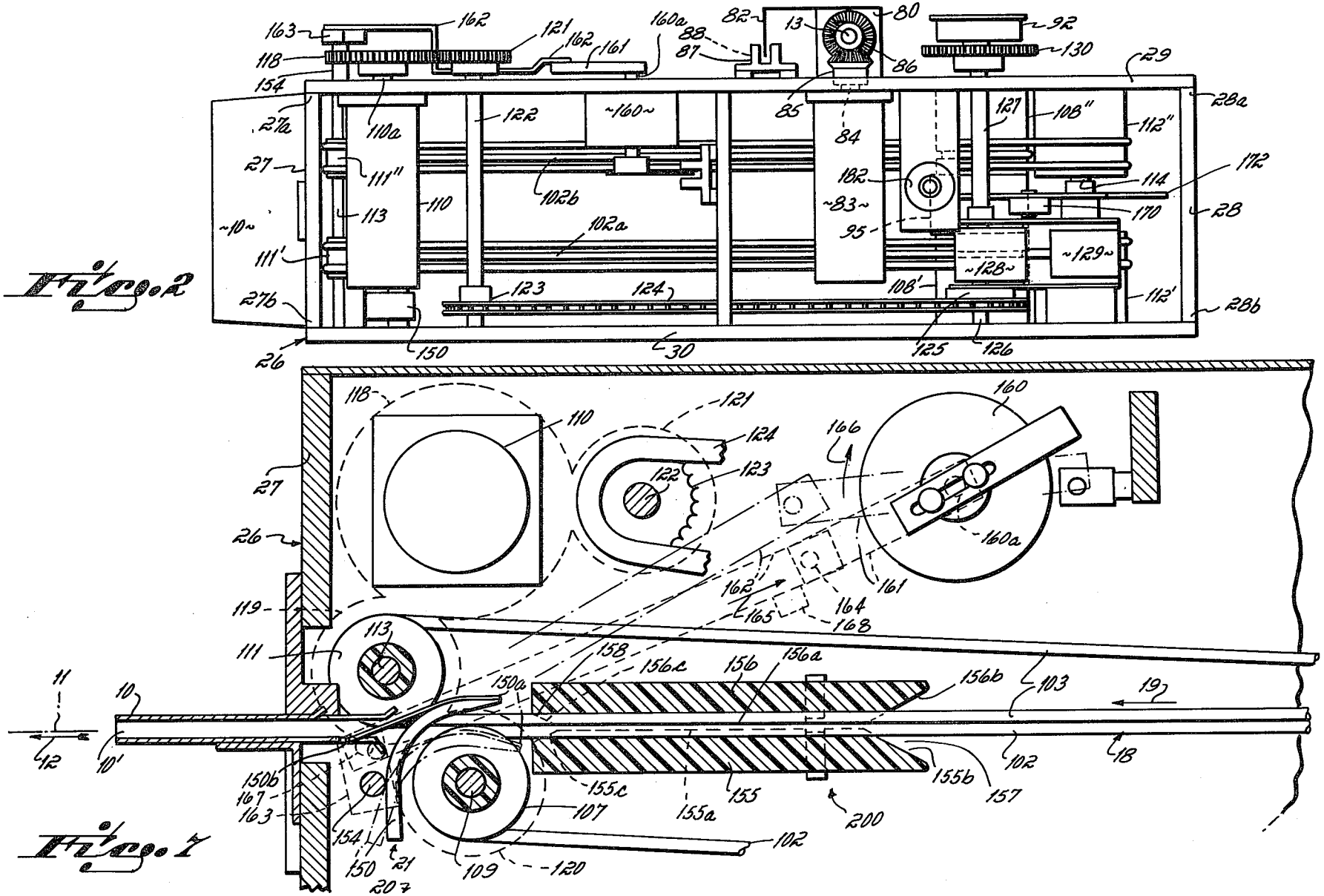
FIG. 2 is a top plan view of the currency dispenser.

The vacuum and air assisted currency feeder assembly 16 includes a source of pressurized air which is designed to riffle or separate the righthand end (as viewed in FIGS. 1 and 3) of the bills at the top of the stack proximate the opening defined by container edges 47*a* and 44*a*. The pressurized air source, in a preferred form, takes the form of an elongated horizontal pipe 90 disposed parallel to the container edge 44*a*. The pipe 90 at one end connects to a source of pressurized air, preferably the outlet of an air pump 92, and at its other end is closed. A plurality of orifices in the form of vertically disposed, horizontally spaced slits are provided in the wall of the pipe to direct an air blast across the container in the direction of arrows 91 against the rear edges of the uppermost bills in the stack 14. When the air issues from the pipe 90 in the direction of arrows 91 the uppermost few bills in the stack 14 are separated, particularly the righthand edges thereof (as viewed in FIGS. 2 and 3). In the course of separating the bills with the air jets 91 the rear marginal portions of the bills proximate thereto are elevated in the direction of arrow 93 toward the rotary vacuum pickup drum 95 to be described.

The vacuum pickup drum 95, which extends across the central one-third of the distance between frame side walls 29 and 30 (FIG. 6), is generally cylindrical in form and mounted for rotation about a horizontal hollow shaft 96 which is journaled for rotation at opposite ends in bearings mounted in the left and right frame side walls. The axes of the drum 95 and shaft 96 are concentric. The drum 95 is ground flat (see FIG. 3*a*) to provide a suction head having transverse flat planar surface 97. When the drum 95 is in the position shown in FIG. 3, herein termed the "6 o'clock" position, the flat drum surface 97 overlies the righthand end of the uppermost bill 14 in stack 14. Communicating with the flat planar surface 97 of the vacuum pickup drum 95 are a set of radially disposed orifices 98 which connect via hollow shaft 96 to the air pump 92. For reasons to become apparent hereafter, orifices 98 are connected to the input of the air pump 92 which has its output connected to pipe 90 which riffles the bills (FIG. 10).

Figure 3:
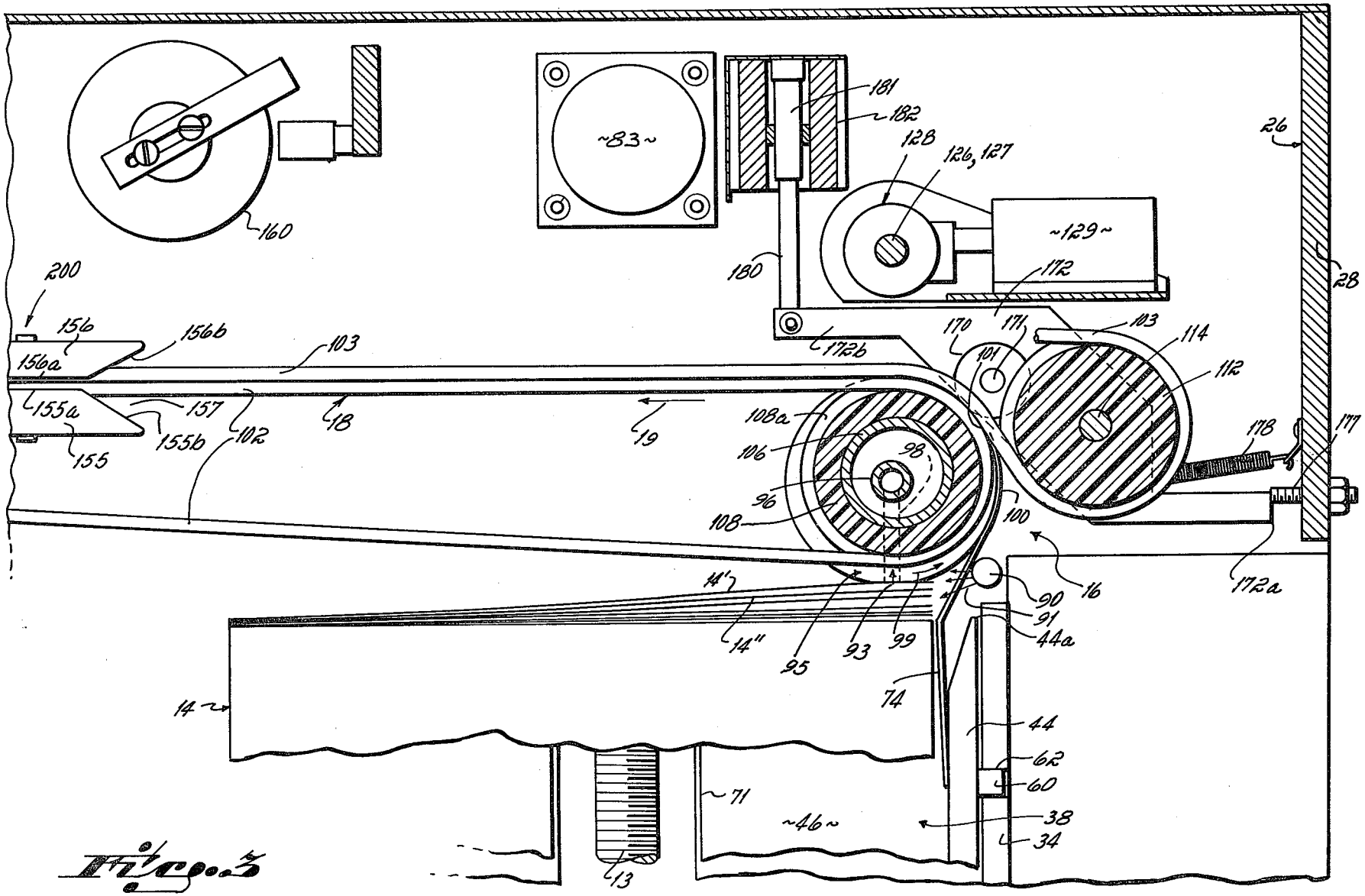
FIG. 3 is a cross-sectional view of the vacuum and air assisted feeder assembly.

With the vacuum pickup drum in the "6 o'clock" position shown in FIG. 3 with the orifices 98 overlying the righthand end of the uppermost bill 14' in the stack 14, when the bills are riffled by the air jets 91 from the pressurized supply pipe 90, the uppermost bill 14' is separated from the stack 14 proximate its righthand end and moves in the direction of arrow 93 up against the planar surface 97 of the pickup drum 95. With vacuum applied to the orifices 98 of the pickup drum 95, the uppermost bill in the stack is gripped by the drum 95.

When the drum is now rotated in the direction of arrow 99 about the shaft 96, the uppermost bill held thereagainst by vacuum begins to wrap around the drum in the course of which the leading edge thereof passes between the periphery of the drum and a stationary curved guide plate 100. At the same time, the air jets 91 are directed between the wrapped, uppermost bill 14' and the next lowest bill 14'', tending to separate the bills 14' from the rest of the stack. If, as preferred, orifices 98 and pipe 90 are connected to the input and output of the same air pump, once the uppermost bill 14' seats on drum surface 97, the pump input defined by the orifices is restricted, reducing the pump output to the pipe 90 and in turn the force of jets 91. A reduction in force of the air jets 91 once the uppermost bill 14' has been sucked against surface 97 by the vacuum in orifices 98 is desirable since riffling action is no longer necessary, it being only necessary to have sufficient air in jets 91 to peel away or separate the bill 14' from the rest of the stack 14.

Continued rotation of the drum 95 in the direction of arrow 99 advances the leading edge of the vacuum-gripped bill into the nip 101 of lower and upper belt sets 102 and 103 moving in the direction of arrow 19 which constitute a portion of the currency transporting belt assembly 18. The bill now advances from the nip 101 between the belt sets 102 and 103 toward the diverter assembly 21 whereat the bill is either diverted downwardly into the underlying bin 20 or fed through the chute 10 for manual removal by the customer.

When the vacuum pickup drum 95 has driven through an angle of approximately 270° from the position shown in FIG. 3, which occurs as the leading edge of a bill being transported by belt sets 102 and 103 passes leftwardly (FIGS. 1 and 3) of bill feeder assembly 16, but before it reaches the diverter assembly 21, a one revolution two position clutch through which the drum 95 is driven is de-actuated and the drum comes to rest with the orifices 98 at approximately the "9 o'clock" position, as viewed in FIG. 3. The drum is now in its "home" or "rest" position ready for the feeding and dispensing of the next bill from the top of the stack 14. In addition, the pump, which constitutes the source of air and vacuum, is de-energized. By stopping the drum 95 in the 9 o'clock position and cutting off the vacuum, there is no change of gripping the trailing edge of the bill which has just been fed which could occur were the home position at 6 o'clock and the vacuum not cut off each cycle. When it is desired to feed the next bill, the one revolution two position clutch is activated along with the pump 92 which constitutes the source of pressurized air and vacuum. The air jets 91 riffle the bills and elevate the uppermost bill into contact with the drum periphery in the manner described. When the drum has rotated 90° clockwise in the direction of arrow 99 from the home position, that is, to the "6 o'clock" position as viewed in FIG. 3, in which position the drum remains for 1–2 seconds, the uppermost bill is gripped by the vacuum orifices 98, and as the drum rotates further the gripped bill is advanced into the nip 101 where it is picked up between the belt sets 102 and 103 of belt assembly 18 and advanced to the diverter for delivery either to the rejected bill bin 20 or the delivery chute 10 for manual removal by the customer.

The lower belt set 102 includes two separate belts **102*a* and 102*b* which at one end, i.e., the rear end, train over a pair of spaced apart peripherally grooved rolls or drums 108' and 108'' located on either side of the pickup drum 95. The belts 102*a* and 102*b* train over concentric spaced peripherally grooved drums or rolls 107' and 107''. Drums 108' and 108'' are mounted for rotation about the same horizontal axis, and are secured to a hollow shaft 106 which surrounds shaft 96 on which the vacuum pickup drum spans frame walls 29 and 30 with respect to which it is journaled. Rolls 107' and 107'' are mounted for rotation with a shaft 109 which spans frame side walls 20 and 30 in which it is journaled. Drum 107' and 107'', in a manner described hereinafter, are driven from a motor 110, while drums 108' and 108''** are idlers.

The upper belt set 103 includes four belts **103*a*, 103*b*, 103*c* and 103*d*. Upper belts 103*a* and 103*b* train over peripherally grooved drive and idler rollers 111' and 112' which are mounted on shafts 113 and 114 spanning frame walls 29 and 30 with respect to which the shafts are journaled. Upper belts 103*c* and 103*d* train over peripherally grooved drive and idler rollers 111'' and 112'' which are also mounted on shafts 113 and 114. By virtue of the location of the rolls 12' and 112'' adjacent and rearwardly (rightwardly as viewed in FIG. 1) of the rolls 108' and 108'', the lower run of the upper belts 103*a*–103*d* partially wrap the drums 108' and 108''. This assures that the upper surfaces of the upper reaches of lower belts 102*a* and 102*b* will lie in the same horizontal bill transport plane as the lower surfaces of the lower runs of upper belts 103*a*–*103d*, in turn insuring that a bill disposed therebetween will be frictionally transported thereby. With reference to FIGS. 4, 5 and 6, it is apparent that the lower runs of upper belts 103*a* and 103*b* are disposed on opposite sides of the upper runs of belt 102*a*, with belt 102*a* riding in peripheral groove 108*a* of drum 108' and belts 103*a* and 103*b* riding on adjacent nongrooved peripheral surfaces of the drum 108'. Similarly, belt 102*b* rides in peripheral groove 108*b* of drum 108'', with belts 103*c* and 103*d* riding in the nongrooved adjacent peripheral surfaces of the drum 108''**.

The vacuum pickup drum 95, which is disposed between the rolls 108' and 108'', is mounted eccentrically with respect to the rolls 108' and 108''. Specifically, the axis of the drum 95 is below and forwardly (leftwardly as viewed in FIGS. 1 and 9) of the axis of rolls 108' and 108''. The diameter of the pickup drum 95 is slightly larger, e.g., one-eighth inch, than the diameter of the rolls 180' and 108''. By virtue of the axially offset mounting and different diameters of the pickup drum 95 and the rolls 108' and 108'', the pickup drum 95 and rolls 108' and 108'' have their peripheral surfaces substantially aligned through an angular sector of approximately 60° between 12 o'clock and 2 o'clock as viewed in FIG. 9. Since the nip 101 starts at approximately 2 o'clock, when the leading edge of a bill gripped by drum 95 enters the nip the periphery of the drum will be substantially coincident with the periphery of the rolls 108' and 108'', assuring proper feed of the leading edge of the bill into the nip. At the 12 o'clock position the leading edge of the bill leaves the pickup drum 95, continuing in a horizontal path in the direction of arrow 19 between the belt sets 102 and 103. At the 12 o'clock position, the periphery of the drum 95 and the periphery of the rolls 108' and 108'' begins to become noncoincident. At the 6 o'clock position of the pickup drum 95, the periphery of the pickup drum is approximately one-eighth inch below the periphery of the rolls 108' and 108''. By virtue of this separation between the surface of the drum 95 and that of the pickup rolls 108' and 108'', there will be minimal interference between the pickup rolls 108' and 108" and their associated belts 102a and 102b when the pickup drum surface 97 containing vacuum orifices 98 first grips the leading edge of a bill to begin feeding toward nip 101.

The motor 110 drives the upper and lower set of belts 102 and 103 through the drums 107', 107" and 111', 111" and is mounted to the left side wall 29 such that its shaft 110a is horizontally disposed, extending through an oversized aperture formed in the left frame wall. Secured to the shaft 110a outward of wall 29 is a gear 118 which meshes with gears 119 and 120 formed on shafts 113 and 109, respectively, to which drums 111', 107", 111" and 107' are secured, respectively. Shafts 109 and 113 each have an extension outboard of the left frame wall 29 to which the gears 120 and 119 are secured.

The vacuum pickup drum 95 which is mounted between idler drums 108' and 108" on shaft 96 is also driven by the motor 110. Specifically, gear 118 secured to motor shaft 110a of motor 110 meshes with a gear 121 mounted on a horizontal shaft 122 journaled at its opposite ends in left and right frame walls 20 and 30. Secured to the shaft 122 proximate the inside surface of the right frame wall 30 is a sprocket 123 which via a chain 124 drives a sprocket 125 journaled for rotation on a stub shaft 126 which extends inwardly from the right frame side wall 30. Interconnecting the shaft 126 and a second stub shaft 127 coaxial thereto which is journaled in left frame wall 29 is a one revolution two position clutch 128 selectively operated by a solenoid 129. A gear 130 secured to the end of the stub shaft 127 outboard of the left frame wall 29 meshes with a gear 131 secured to the shaft 96 on which the vacuum pickup drum 95 is mounted. Thus, when the motor 110 is energized and the solenoid 129 activated, the drum 95 rotates for one bill pickup cycly of operation through a power train which includes shaft 110a of motor 110, gear 118, gear 121, shaft 122, sprocket 123, chain 124, sprocket 125, shaft 126, two position clutch 128, shaft 127, gear 130, gear 131, and shaft 96. Once the vacuum pickup drum 95 has been driven through one operational cycle, during which time a bill has been picked up and fed from the top of the stack 14 to the belts 120 and 103, continued rotation of the shaft 127 by the chain driven sprocket 125 is ineffective to rotate shaft 127, gears 130 and 131 and drum shaft 96; hence, the vacuum pickup drum 95 remains stationary. However, continued energization of the motor 110 continues to drive the drums 111' and 111" and 107' and 107" via gears 118, 119 and 120 and shafts 113, 109 to advance the belt sets 102 and 103 in the direction of arrow 19 to transport a bill from the nip 101 to the diverter 21 whereat the bill is either delivered to the underlying rejected bill bin 20 or advanced through the chute 10 for manual removal by the customer. If the bill is not diverted into the bin 20, the motor 110 is de-energized, following a suitable time delay necessary to insure that the bill extends outwardly from the chute 10 to facilitate manual removal by the customer and is free of the belts 102 and 103, by a suitably positioned photocell (not shown) located proximate the diverter which senses that the bill has advanced beyond the point where it is diverted to the bin. If the bill is diverted into the bin 20, the motor 110 is not de-energized, but instead remains energized to initiate another bill-feeding cycle.

The diverter assembly 21 is alternatively operable to effect delivery of a bill transported in the direction of arrow 19 by upper and lower belt sets 102 and 103 to either the underlying rejected bill bin 20 or into the chute 10 for manual removal by a customer. With reference to FIGS. 1, 4 and 7, the diverter includes a plurality of curved bars 150, 151, 152 and 153. The curved bars 150–153 are secured to a horizontally disposed shaft 154 which is journaled at its opposite ends in left and right frame side walls 29 and 30. When the shaft 154 is rotated between limit positions in a manner to be described, the curved bars 150–153 are selectively positioned between an upper position shown in solid lines in FIG. 7 and a lower position shown in phantom lines. In the upper position, the inner rearward tips 150a, 151a, 152a and 153a of the curved bars 150, 151, 152 and 153 are disposed above the path of a bill being transported in the direction 19 by lower and upper belt sets 102 and 103. In such upper position a bill moving in the direction of arrow 19 between the cooperating upper run of lower belt set 102 and lower run of upper belt set 103 will be diverted downwardly into the underlying rejected bill bin 20 when the leading edge of the transported bill engages the lower curved surface of the diverter bars 150, 151, 152 and 153. In the lower position of the diverter bars shown in phantom in FIG. 7, the inner tips 150a–153a of diverter bars 150–153 are disposed below the path of a bill transported by cooperating belt sets 102 and 103. With the diverter bar tips 150a–153a so positioned, a transported bill passes over the curved diverter bars 150–153, ultimately being delivered to the customer through the chute 10.

To facilitate a smooth transition of a transported bill from a point upstream of the diverter assembly 21 to the chute 10 when the curved diverter bars 150, 151, 152 and 153 are in their nondiverting downward position shown in phantom lines in FIG. 7, guide plates 150b, 151b, 152b and 153b are provided. Guide plates 150b, 151b, 152b and 153b are secured at their righthand ends, as viewed in FIG. 7, to the curved diverter bar tip 150a, 151a, 152a, and 153a, respectively. When the curved diverter bars 150, 151, 152 and 153 are in their nondiverting position shown in phantom lines in FIG. 7, the guide plates 150b, 151b, 152b and 153b are disposed slightly below the path of a bill transported between the cooperating upper and lower reaches of the lower and upper belt sets 102 and 103. Thus, when the diverter assembly 21 is in its nondiverting position, shown in phantom lines in FIG. 7, a transported bil guides over diverter guide plates 150b, 151b, 152b and 153b, assuring a smooth transition of the bill from a point upstream of the diverter assembly 21 to the chute 10.

To facilitate positively locating the leading edge of the bill transported by the belt asembly 19 at a point slightly upstream of the diverter assembly 21, a pair of horizontal guide plates 155 and 156 are provided. The upper surface 155a of the lower guide plate 155 and the confronting lower surface 156a of the upper guide plate 156 are spaced apart slightly to define therebetween a horizontal bill transport slot. A bill transported in the direction of arrow 19 between the upper reach of lower belt set 102 and the lower reach of upper belt set 103 enters the slot defined by the confronting surfaces of plates 155 and 156 at the converging throat 157 formed by inclined surfaces 155b and 156b of guide plates 155 and 156. Eventually the transported bill exits at the diverging throat 158 formed by angled surfaces 155c and 156c of guide plates 155 and 156, respectively. Since the guide plates 155 and 156 are stationarily mounted between the frame side plates 29 and 30 the point at which a transported bill leaves the guide plate throat region 158 slightly upstream of the diverter assembly 21, is relatively fixed, assuring reliable feeding of the leading edge of a bill to the diverter assembly 21.

To pivot the curved diverting bars 150–153 from their normal diverting position shown in solid lines in FIG. 7 to the nondiverting position shown in phantom lines in FIG. 7 a rotary solenoid 160 is provided which rotates, via links 161, 162 and 163, the shaft 154 to which the diverter bars 150–153 and guide bars **150*b*–153*b* are secured. Link 161 at one end is secured to the rotary output shaft 160*a* of the rotary solenoid 160 and at its other end is pivotally mounted to one end of the link 162. The other end of the link 162 is pivotally mounted to one end of the link 163. The other end of the link 163 is fixed to the shaft 154. When the rotary solenoid 160 is deenergized, which is its normal condition, the links 161–163 assume the dotted line position shown in FIG. 7, placing the diverter bars 150–153 in their position (shown in solid lines) to divert a transported bill to the underlying bin 21**.

If a bill transported by belt assembly 19 is to be delivered to the chute 10 for manual removal by the customer, the solenoid 160 is energized. This pivots solenoid shaft **160*a*, and in turn link 161, clockwise as viewed in FIG. 7 in the direction of arrow 166. Pivoting of link 161 provides a rightward force (as viewed in FIG. 7) to the link 162, moving it into the phantom line position, which in turn pivots link 163 and shaft 154 clockwise. This places the diverter bars 150–153 in their nondiverting downward (phantom line) position, such that a bill transported by belt assembly 19 will pass over guide plates 150*b*–153*b* into chute 10** for manual removal by the customer.

Should an effort be made to compromise the security of the bill dispenser by inserting a tool, such as a screwdriver or the like, into the chute 10 to pivot the diverter elements 150–153 clockwise about shaft 155, as viewed in FIG. 7 in an effort to fish out bills from the rejection bin 20, the attempted compromise likely will be unsuccessful. Specifically, any effort to pivot the curved diverter bars 150–153 clockwise about the shaft 154 by insertion of a tool in the chute 110 will cause a force to be transmitted along the link 162 in the direction of arrow 165. Since the pivot pin 164 joining solenoid-actuated link 161 and the link 162 is below a straight line joining the centers of solenoid shaft **160*a* and a pivot pin 167 which joins links 163 and 162, application of a force along link 162 in the direction of arrow 165 will have the tendency to rotate the solenoid-actuated link 161 counterclockwise. Counterclockwise rotation of solenoid-actuated link 161 is prevented by means of a suitably positioned stop member 168**.

To detect the simultaneous feeding of multiple bills a thickness detector is provided. The thickness detector, if it senses the simultaneous feed or more than one bill, prevents energization of the diverter solenoid 160 and thereby insured that the multiple bills are diverted into the bin 20. The thickness detector includes a roll 170 mounted about a horizontal stub shaft 171 extending from a bracket 172 which is mounted for pivotal movement about a horizontal shaft 114 secured at its opposite ends between frame side walls 29 and 30. The bracket 172 has a rearwardly extending ear **172*a* which abuts a horizontally adjustable stop 177 extending forwardly from the rear wall 28. The stop 177 is adjusted to permit the periphery of the roll 170 to ride on the surface of the pickup drum 95 which senses as a reference surface for the thickness-sensing roll 170. A tension spring 178 secured between the rear frame wall 28 and the bracket 172 biases the periphery of the roll 170 toward the periphery of the pickup drum 95. Extending in a forward direction from the bracket 172 is an ear 172*b*. Ear 172*b* is pivotally connected to the lower end of a rod 180 which at its upper end is secured to the core 181 of a linear variable displacement transformer 182**.

Suitable electrical circuitry (not shown) associated with the output of the linear velocity displacement transformer 182 is provided to sense upward movement of the core 181 beyond a predetermined limit corresponding to the passage of a single bill between the periphery of the roll 170 and the drum 95. If more than a single bill is positioned between the roll 170 and drum 95, the bracket 172 pivots clockwise as viewed in FIG. 3 about shaft 175, which in turn elevates the rod 180 and the core 181 a distance sufficient to provide an output from the linear variable displacement transformer 182 to trigger the associated circuit which, when triggered, precludes energization of the diverter solenoid 160, in turn insuring that the multiple bills are diverted into the underlying bin 120. (See also FIG. 9.)

In addition to the multiple bill detector described immediately above, a phototransducing assembly 200 is positioned along the transport path of the bills between the diverter assembly 19 and thickness test roll 170 at a distance from roll 170 slightly in excess of the length of a single bill. If a single bill is fed by the belt assembly 18, the phototransducer assembly 200 will not be activated simultaneously with an output from the linear variable displacement transformer 182 indicating presence of a bill between roll 170 and drum 95 since the phototransducer 200 and roll 170 are spaced apart a distance slightly greater than the length of a bill. However, should multiple bills be fed in a overlapped condition, phototransducing assembly 200 will become activated simultaneously with the output from the linear variable displacement transformer 182 indicating the presence of overlapped bills. When this occurs suitable electrical circuity (not shown) responsive to the phototransducer assembly 200 and the linear variable displacement transformer 182 will provide an output to preclude energization of the diverter solenoid 160 and in turn insure that the overlapped bills are diverted into the underlying rejected bill bin 20.

With reference to FIG. 11, a diagrammatic circuit in block diagram format is shown which could be utilized to control various electrical elements of the dispenser such as the motor 110 which drives the belts 102 and 103 and the vacuum pickup drum 95, the diverter solenoid 160 which controls the diverter bars 150–153, and the motor 83 which reciprocates the stack-elevating platform 15.

Included in the control circuit of FIG. 11 is a non-feed detector circuit 205 which provides a signal on its output line 206 to the platform elevating motor 83, to energize the motor for a predetermined period of time and thereby increment the platform a predetermined distance upward, when rotation of the vacuum pickup drum 95 through a single rotary cycle does not result in the feeding of the uppermost bill of the stack to the nip 101 for tansport by the belts 102, 103 to either the chute 10 or the reject bin 20. The phototransducer assembly 200 could be included in the non-feed detector circuit 205 to provide an indication that a bill has in fact been fed from the stack when the rotary vacuum pickup drum 95 is cycled. Alternatively, the LVDT 182 and associated circuitry could be used to indicate feed of a single bill. In addition, the non-feed detector circuit 205 could also include means for providing a signal when the pickup drum 95 has cycled through one revolution. In the absence of a signal from the phototransducer 200 indicating that a bill has passed between guide plates 155 and 156 following cycling of the rotary pickup drum 95, the increment signal on line 206 is generated to momentarily energize the platform motor 83 and increment the stack toward the pickup drum.

The control circuit of FIG. 11 also includes a multiple/overlapped bill detector circuit 207 for providing a signal on its output line 208 to the diverter solenoid 160 and the belt and pickup drum motor 110 when multiple/overlapped bills are sensed by, for example, the linear variable displacement transformer 182. The signal on line 208 generated by the multiple/overlapped bill detector circuit 207 when multiple/overlapped bills are detected is input to the diverter solenoid 160 to maintain the diverter solenoid 160 in a de-energized state such that the multiple bills will be delivered into the underlying reject bill bin 20. The output signal on line 208 generated in response to the feeding of multiple/overlapped bills is also input to the belt and pickup drum 110 to recycle the vacuum pickup drum 95 and the belts 102, 103 such that a second attempt will be made to feed a single bill from the top of the stack and transport it to the customer via the delivery chute 10.

The bill arrival detector circuit 209 produces a signal on its output line 210 upon arrival of a single bill at the chute 10. The output signal on line 210, when input to the belt and pickup drum motor 110, is effective to de-energize the motor and terminate movement of the belts when a single bill has been fed from the top of the stack and transported by the belts for delivery to the customer chute 10. The bill arrival detector circuit 209 can operate on the output of the multiple/overlapped bill circuit and the phototransducer assembly 200 which collectively provide signals indicating that a single bill has been fed. In such case, the diverter bars 150–153 are placed in their lower position to pass the bill to the chute. The output from the bill arrival detector circuit 209 on line 210 is also input to the belt and pickup motor 110, to interrupt the cycling of the motor 110, precluding the feed of another bill from the top of the stack and transport to the chute 10 until the previously fed and transported bill has been removed by the customer.

A bill removal circuit 212 is included to provide a signal on line 213 to the belt and pickup drum motor 110 when a single bill which has arrived in the chute 10 is removed by the customer. The bill removal circuit 212 can include, for example, a phototransducer assembly (not shown) in the chute 110 which, when the phototransducer detects removal of a bill, provides a signal on line 213 to the belt and pickup drum motor 110 to initiate energization of the motor and recycle the pickup drum 95 and the belts 102, 103 for feeding the next bill from the stack.

If desired, the control circuit can be designed to retract a bill delivered to the customer chute 10 back into the machine for delivery to the reject bin 20 in the event a customer has not removed the bill after the lapse of a predetermined time, such as five seconds. If such is desired, a bill nonremoval circuit 215, including a timer initiated upon arrival of a single bill in the chute 10 is provided. If the bill has not been removed when the timer times out, such as after five seconds from arrival of the bill in the chute 10, a signal on line 216 is produced to energize the belt and pickup drum motor 110 in a reverse direction to retract the bill. When the bill, which is now moving rightwardly as viewed in FIG. 7, has passed in its entirety back over the diverter bars 150–153, which are in the lower phantom line position by virtue of energization of the diverter solenoid 160 via a signal on line 217, the diverter solenoid 160 is de-energized, allowing the diverter bars to move to the upper position and the direction of the motor 110 is reversed to feed the bill into the underlying reject bin 20.

The control circuit of FIG. 11 can take the form of a special purpose solid state logic circuit, or alternatively the various control signals for the belt and pickup motor 110, diverter solenoid 160 and platform motor 83 can be provided, in response to suitable signals provided by the multiple bill detector, phototransducers and the like, by a specially programmed general purpose computer.

Having thus described the invention, I claim:

1. A currency dispenser for sequentially feeding single bills of currency from the top of a vertical stack of superimposed horizontally disposed bills, comprising:

a vacuum pickup member overlying said stack, said pickup member having a suction head and being mounted for rotation about a first generally horizontal axis whereby said suction head moves through a circular path when said pickup member rotates about said first horizontal axis, said path at its lower extremity being proximate a pickup region defined by the location of the uppermost bill of said underlying vertical stack, upper and lower cooperating feed belts trained over upper and lower sets of spaced rotatable cylindrical rolls for transporting a bill therebetween, one of the rolls of said lower set being rotatable about a second generally horizontal axis, means for moving said belts during an operational cycle to effect transport of a bill therebetween along a transport path from the nip of a bill entrance end proximate said one roll of said lower set to a bill exit end displaced therefrom, means to rotate said pickup member about said first axis during said operational cycle, means for mounting said upper and lower sets of rolls for rotation about their respective axes with said one roll axially displaced relative to said pickup member and with said second axis of said one roll generally parallel to, but offset from, said first axis of said pickup member for rendering said circular path of said suction head noncoincident with and below the surface of said one cylindrical roll in said pickup region while rendering said circular path substantially coincident with said surface of said one cylindrical roll in the region of said nip, thereby minimizing interference in said pickup region between the uppermost bill of said stack and said lower feed belt during vacuum pickup by said suction head of said uppermost bill from the top of said stack while maximizing transfer of a bill from said suction head to said upper and lower belts in the region of said nip, said second axis of said one roll lying on an imaginary line which passes through the area defined by said path of said suction head to facilitate pickup of a bill in said pickup region by said suction head and transfer to said belts in less than 360° of movement of said suction head.

2. The currency dispenser of claim 1 wherein said feed belts are disposed to overlie said currency stack with said exit end proximate the end of said stack remote from said pickup region, said currency dispenser further including a bill-diverting element mounted proximate said exit end of said belts for movement between first and second positions for directing a bill transported between said belts alternatively to (a) a reject point below said bill-diverting element adjacent said stack, and (b) a delivery point, respectively, a multiple bill sensor disposed along said bill transport path for detecting bills which are at least partially overlapped, and means responsive to said sensor for controlling said bill-diverting element to divert multiple bills to said reject point and single bills to said delivery point.

3. The currency dispenser of claim 2 wherein said sensor includes;

a currency-contacting element biased toward said pickup roll, means mounting said currency-contacting element for movement relative to said pickup roll varying amounts as varying numbers of overlapped bills pass therebetween, and said means responsive to said sensor being responsive to movement of said currency-contacting element for controlling said bill-diverting element.

4. The currency dispenser of claim 2 further including means for controlling said pickup member rotating means and said belt moving means, said controlling means being operative to repeatedly cycle said pickup member and said belts in the event multiple bills picked-up by said suction head and transported by said belts are diverted to said reject point to repeatedly attempt to pickup and transport a single bill from said stack to said delivery point.

5. The currency dispenser of claim 4 wherein said controlling means is operative to interrupt cycling of said belts and pickup member when a bill picked-up by said suction head is transported by said belts to said delivery point, said controlling means being further operative to resume cycling of said pickup member and belts following interruption only after said bill has been removed from said delivery point.

6. The currency dispenser of claim 2 further including:

a bill non-removal sensor circuit responsive to non-removal by a customer of a bill transported to said delivery point for producing a control signal for reversely moving said belts to retract said bill and thereafter forwardly moving said belts and controlling said bill-diverting element to divert said retracted bill to said reject point, whereby multiple bills and non-removed bills are diverted to said reject point.

7. The currency dispenser of claim 1 further including:

stack elevating means underlying said stack, including a stack-supporting platform and means for incrementally moving said platform to raise said stack a predetermined increment, means repeatedly responsive to the repeated failure to feed a bill from the top of said stack upon repeated rotations of said pickup member for repeatedly activating said incrementing means to repeatedly raise said platform and stack said predetermined increment, thereby elevating said stack to the desired operating level without utilizing a stack height sensor for sensing the level of the uppermost bill.

8. The currency dispenser of claim 1 further including:

a fluid nozzle for directing a fluid jet against the edges of said uppermost bills in said stack proximate said pickup region to separate same, and a single fluid pump having an outlet connected to said nozzle and an inlet connected to said suction head for simultaneously supplying pressurized fluid and vacuum to said nozzle and suction head, respectively, said supply of pressurized fluid decreasing independent of the specific angular orientation of said suction head when said suction head picks up a bill.

9. The currency dispenser of claim 1 further including means for controlling said pickup member rotating means and said belt moving means, said controlling means being operative twice per operational cycle to initiate rotation of said pickup member to sequentially advance said suction head through said pickup region to said nip, and thereafter, while said belts are transporting said bill to said exit end, terminating said suction head movement at a further position in said circular path between said nip and pickup region to avoid grabbing said transported bill with said suction head at a point proximate the trailing edge thereof.

10. The currency dispenser of claim 6 wherein said controlling means includes a single motor common to both said pickup member rotating means and said belt moving means, and a one revolution two position clutch connected between said motor and said pickup member.

11. The currency dispenser of claim 1 further including controlling means operative to interrupt cycling of said belts and pickup member when a bill picked-up by said suction head is transported by said belts to said exit end, said controlling means being further operative to resume cycling of said pickup member and belts following interruption only after said bill has been removed from said exit end.

12. The currency dispenser of claim 9 wherein said controlling means is additionally operative to repeatedly cycle said pickup member and said belts in the event bills picked-up by said suction head and transported by said belts are diverted from said exit end to repeatedly attempt to pickup and transport a bill from said stack to said exit end.

13. The currency dispenser of claim 1 further including:

a frame structure mounting said pickup member, said pickup member rotating means, said upper and lower sets of rolls, said belt moving means, and said roll mounting means, a container separable from said frame structure and configured to contain said stack, said container having interconnected walls, floor and ceiling, said container being removably positionable in said frame with said ceiling having an opening therein adapted to underlie said pickup member when said container is positioned within said frame, and cooperating locating means associated with said frame and container for positively locating said container relative to said pickup member when said container is positioned within said frame.

14. The currency dispenser of claim 13 further including:

a stack-support adapted to underlie said stack when said container is positioned in said frame with said ceiling opening underlying said pickup member, means mounted to said frame for supporting said stack-support for reciprocating movement toward and away from said pickup member, stack-support drive means mounted to said frame for selectively reciprocating said stack-support, said stack-support, said stack-support mounting means, and said stack-support drive means being structurally independent of said container, and said container having a slot in one of said walls configured to permit insertion and reciprocation of said stack-support within said container when said container is located within said frame.

15. The currency dispenser of claim 14 wherein one of said walls is movable and selectively positionable in different positions relative to another of said walls located opposite thereto to accommodate bills of varying size, said currency dispenser further including means to releasably secure said movable wall in said different positions.

16. The currency dispenser of claim 1 further including:

a bill non-removal sensor circuit responsive to non-removal by a customer of a bill transported to said exit end for producing a control signal, and means for reversely moving said belts in response to said control signal for retracting said bill from said exit end to a point inaccessible to said customer.

* * * * *